US010759563B2

(12) United States Patent
Clark et al.

(10) Patent No.: US 10,759,563 B2
(45) Date of Patent: Sep. 1, 2020

(54) BEVERAGE CRATE WITH HANDLE

(71) Applicant: Rehrig Pacific Company, Los Angeles, CA (US)

(72) Inventors: Suzanne Whitfield Clark, Santa Monica, CA (US); William P. Apps, Alpharetta, GA (US)

(73) Assignee: Rehrig Pacific Company, Los Angeles, CA (US)

( * ) Notice: Subject to any disclaimer, the term of this patent is extended or adjusted under 35 U.S.C. 154(b) by 519 days.

(21) Appl. No.: 14/995,682

(22) Filed: Jan. 14, 2016

(65) Prior Publication Data

US 2016/0200479 A1 Jul. 14, 2016

Related U.S. Application Data

(60) Provisional application No. 62/103,550, filed on Jan. 14, 2015.

(51) Int. Cl.

| | |
|---|---|
| ***B65D 21/02*** | (2006.01) |
| ***B65D 25/28*** | (2006.01) |
| ***B65D 1/24*** | (2006.01) |
| ***B65D 71/56*** | (2006.01) |

(52) U.S. Cl.

CPC ..... *B65D 21/0233* (2013.01); *B65D 1/243* (2013.01); *B65D 25/2891* (2013.01); *B65D 71/0014* (2013.01)

(58) Field of Classification Search

USPC ..... 206/162, 201, 203, 142, 143, 515, 518, 206/519

See application file for complete search history.

(56) References Cited

U.S. PATENT DOCUMENTS

| | | | |
|---|---|---|---|
| D10,386 | S | 1/1878 | Hopkins |
| D14,798 | S | 2/1884 | Swapp |
| D17,266 | S | 4/1887 | Hoban |
| D18,989 | S | 4/1889 | Morel |
| D19,570 | S | 1/1890 | Palmer |
| D20,811 | S | 6/1891 | Jackson |
| D20,986 | S | 8/1891 | Pegel |
| D22,967 | S | 12/1893 | Gulick |
| D23,921 | S | 12/1894 | Tatum |
| D26,879 | S | 4/1897 | Notciikiss |
| D27,514 | S | 8/1897 | Macintosh |

(Continued)

FOREIGN PATENT DOCUMENTS

| | | |
|---|---|---|
| EP | 464894 B1 | 1/1992 |
| GB | 2017645 A | 10/1979 |

*Primary Examiner* — Jacob K Ackun

(74) *Attorney, Agent, or Firm* — Carlson, Gaskey & Olds, P.C.

(57) ABSTRACT

A nestable crate includes a base, a pair of opposed side walls extending upward from the base, and a pair of opposed end walls extending upward from the base. The side walls and end walls include an upper band portion and a lower portion connecting the base to the upper band portion. A center structure extends from one of the end walls to the other of the end walls. The center structure includes a plurality of center column portions extending down to the base. The center structure further includes an upper handle portion partially defining a handle opening therebelow. The upper handle portion includes spaced-apart handle side walls defining openings upward of the crate.

2 Claims, 17 Drawing Sheets

(56) References Cited

U.S. PATENT DOCUMENTS

D28,310 S 2/1898 Hoyt
D28,484 S 4/1898 Jackson
D30,412 S 3/1899 Colgate
D31,349 S 8/1899 Lewald
D31,767 S 10/1899 Astarita
D31,855 S 11/1899 Culmer
D32,797 S 6/1900 Parker
D32,993 S 7/1900 Taylor
D36,143 S 11/1902 Osborne
D37,912 S 3/1906 Mcnab
820,445 A 5/1906 Speer
D38,061 S 6/1906 Crownfield
D38,090 S 6/1906 Codman
D39,595 S 9/1908 Colby
D39,815 S 2/1909 Bomeister
D39,906 S 4/1909 Boman
D40,001 S 5/1909 Dieges
D40,176 S 7/1909 Booth
D40,420 S 12/1909 Emostd
D41,778 S 9/1911 Lefkowitz
D42,022 S 12/1911 Satjeb
D46,252 S 8/1914 Humphrey
D46,863 S 1/1915 Despres
D48,763 S 3/1916 Boede
D50,501 S 3/1917 Barrows
D50,788 S 5/1917 Johnson
2,411,673 A 11/1946 Vechey, Jr.
D152,907 S 3/1949 Richards
2,512,855 A 6/1950 Erickson
2,526,335 A 10/1950 Deichert
2,530,481 A 11/1950 Rawn, Jr.
2,535,493 A 12/1950 Gerber
2,588,805 A 3/1952 Cross
2,626,079 A 1/1953 Keller
2,743,030 A 4/1956 Read, Jr.
2,760,676 A 8/1956 Knieriem
2,840,256 A 6/1958 Cobb, Jr.
2,928,530 A 3/1960 Sauey
2,935,222 A 5/1960 Oconnell
2,970,715 A 2/1961 Kappel
2,974,819 A 3/1961 Melville
2,979,222 A 4/1961 Levine
3,009,579 A 11/1961 Ettlinger, Jr.
3,045,862 A * 7/1962 De Chelbor ..... B65D 71/0003 206/203
3,055,531 A 9/1962 De Chelbor
3,055,542 A 9/1962 Russo
3,092,284 A 6/1963 Stout
3,106,308 A 10/1963 Kazimier
3,151,762 A 10/1964 Vidal
3,155,268 A 11/1964 Fogerty
3,184,148 A 5/1965 Poupitch
D201,257 S 6/1965 Conn
3,247,996 A 4/1966 Santamaria
3,283,947 A 11/1966 Cornelius
3,297,190 A 1/1967 Cloyd
3,332,574 A 7/1967 Earp
3,333,727 A 8/1967 Belcher
3,333,729 A 8/1967 Rabb
3,334,767 A 8/1967 Cornelius
3,349,943 A 10/1967 Box
3,349,958 A * 10/1967 Breneman ..... B29C 45/2624 206/201
3,376,998 A 4/1968 Cornelius
3,384,261 A 5/1968 Austin
3,390,801 A 7/1968 Adomat
3,391,814 A 7/1968 Box
3,391,815 A 7/1968 Box
3,392,869 A 7/1968 Needt
3,416,694 A 12/1968 Hodson
3,428,207 A 2/1969 Schoeller
3,463,353 A * 8/1969 Peebles ..... B65D 21/0233 206/514
3,517,852 A 6/1970 Schoeller
3,587,915 A * 6/1971 Reiner ..... B65D 21/0233 206/201
3,628,684 A 12/1971 Sere
3,638,824 A 2/1972 Sekiguchi
3,682,351 A 8/1972 De Putter
3,701,449 A 10/1972 Schoeller
3,759,416 A 9/1973 Constantine
3,788,002 A 1/1974 Suchka
3,812,996 A 5/1974 Bunnell
3,865,239 A 2/1975 Herolzer et al.
3,949,876 A 4/1976 Bridges et al.
3,991,879 A * 11/1976 Hirota ..... B65D 1/243 206/203
3,998,237 A 12/1976 Kressin et al.
3,998,328 A 12/1976 Box
RE29,262 E 6/1977 Utz
4,027,796 A 6/1977 Martin
4,037,722 A 7/1977 Bremer
4,040,517 A 8/1977 Torokvei
4,071,162 A 1/1978 Steinlein et al.
4,095,720 A 6/1978 Delbrouck et al.
4,101,049 A 7/1978 Wallace et al.
4,161,259 A 7/1979 Palafox
4,162,738 A 7/1979 Wright
4,202,448 A 5/1980 Jaeger et al.
4,204,596 A 5/1980 Davis
4,234,114 A * 11/1980 Wood ..... B65D 71/0003 206/162
4,256,224 A * 3/1981 Hirota ..... B65D 1/243 206/203
4,295,576 A 10/1981 Steinlein
4,308,966 A 1/1982 Ettema et al.
4,319,685 A 3/1982 David
4,343,400 A 8/1982 Faucillon
4,344,530 A 8/1982 deLarosiere
D266,709 S 10/1982 Box
4,373,627 A * 2/1983 Wood ..... B65D 1/243 206/201
4,387,824 A 6/1983 Wefers
4,410,099 A 10/1983 deLarosiere
4,416,373 A 11/1983 deLarosiere
4,538,742 A 9/1985 Prodel
4,548,320 A 10/1985 Box
4,585,137 A 4/1986 Poutiainen et al.
4,615,444 A 10/1986 de Larosiere
D289,938 S 5/1987 Warwick
D291,178 S 8/1987 Toms
4,700,836 A 10/1987 Hammett
4,700,837 A 10/1987 Hammett
D295,107 S 4/1988 Frost
4,773,554 A 9/1988 Warwick
4,789,063 A 12/1988 Hammett
4,848,580 A 7/1989 Wise
4,899,874 A 2/1990 Apps et al.
4,911,303 A 3/1990 Andersson
4,928,841 A 5/1990 Arthurs
4,932,532 A 6/1990 Apps et al.
4,944,400 A 7/1990 Van Onstein et al.
4,978,000 A 12/1990 Mohr
4,978,002 A 12/1990 Apps et al.
5,031,749 A 7/1991 McCoy
5,031,774 A 7/1991 Morris et al.
D319,129 S 8/1991 Apps et al.
5,040,681 A 8/1991 Grusin
D320,298 S 9/1991 Apps et al.
5,060,819 A 10/1991 Apps
5,071,026 A 12/1991 Apps
5,078,282 A 1/1992 Stanfield
5,096,085 A 3/1992 Eek et al.
D325,279 S 4/1992 Apps
5,105,948 A 4/1992 Morris et al.
D326,749 S 6/1992 Apps et al.
D327,357 S 6/1992 Rehrig
D327,562 S * 6/1992 Brightbill ..... B25H 3/023 D3/308
5,117,979 A * 6/1992 Brightbill ..... B25H 3/023 206/372
5,184,748 A 2/1993 Apps
5,267,649 A 12/1993 Apps et al.

(56) References Cited

U.S. PATENT DOCUMENTS 5,305,884 A 4/1994 Apps et al.
5,316,172 A 5/1994 Apps et al.
5,320,245 A 6/1994 Apps et al.
5,335,814 A 8/1994 Hepp
D350,438 S 9/1994 Apps
5,351,814 A 10/1994 Apps
5,377,862 A 1/1995 Oakes et al.
D356,679 S 3/1995 Apps
5,405,042 A 4/1995 Apps et al.
5,419,451 A 5/1995 Bitel, Jr.
5,421,477 A 6/1995 Hammett
D360,758 S 8/1995 Umiker
5,465,843 A 11/1995 Koefelda
5,487,487 A 1/1996 Hammett
5,495,945 A 3/1996 Apps et al.
5,501,352 A 3/1996 Apps
5,529,176 A 6/1996 Apps et al.
5,575,390 A 11/1996 Apps et al.
D378,249 S 3/1997 Apps et al.
D379,717 S 6/1997 Apps et al.
5,651,461 A 7/1997 Apps et al.
5,660,279 A 8/1997 Apps et al.
5,669,498 A 9/1997 Fierek et al.
5,702,022 A 12/1997 Umiker
5,704,482 A 1/1998 Apps et al.
5,740,934 A 4/1998 Brady
5,769,230 A 6/1998 Koefelda
5,785,170 A 7/1998 Hammett
5,823,376 A 10/1998 McGrath
5,842,572 A 12/1998 Apps et al.
5,855,277 A 1/1999 Apps et al.
D405,006 S * 2/1999 Spencer ..... B25H 3/023 D9/753
D410,778 S 6/1999 Apps
D412,399 S 8/1999 Apps
5,964,343 A 10/1999 Steiner
5,971,204 A 10/1999 Apps
5,979,654 A 11/1999 Apps
6,006,912 A 12/1999 McGrath
6,039,205 A * 3/2000 Flink ..... B65D 1/38 206/520
6,047,844 A 4/2000 McGrath
6,059,109 A * 5/2000 Stein ..... B25H 3/06 206/373
6,073,793 A 6/2000 Apps et al.
6,079,554 A 6/2000 Hammett et al.
6,112,938 A 9/2000 Apps
6,131,730 A 10/2000 Hsu
6,186,328 B1 2/2001 Apps
6,189,734 B1 2/2001 Apps et al.
6,237,758 B1 5/2001 Hsu
D446,015 S 8/2001 Apps
6,401,960 B1 6/2002 Hammett
D461,957 S 8/2002 Hammett
6,454,120 B1 9/2002 Hammett
6,457,599 B1 10/2002 Apps et al.
D465,417 S 11/2002 Apps
D466,018 S 11/2002 Apps
D468,634 S 1/2003 Hammett
D483,946 S 12/2003 Koefelda
D485,756 S 1/2004 Apps
D487,634 S 3/2004 Apps et al.
6,749,065 B1 6/2004 Hammett
D494,867 S 8/2004 Apps
6,851,563 B1 2/2005 Lipari
6,892,885 B2 5/2005 Apps et al.
6,899,247 B1 5/2005 Koefelda et al.
D507,880 S 8/2005 Hassell
6,966,442 B2 11/2005 Hassell et al.
7,011,215 B2 3/2006 Meissen et al.
7,017,746 B2 3/2006 Apps
7,036,666 B2 5/2006 Hammett
7,086,531 B2 8/2006 Apps et al.
7,093,715 B1 8/2006 Apps
7,097,033 B2 8/2006 Koefelda et al.
7,128,234 B2 10/2006 Apps et al.
7,207,458 B1 4/2007 Koefelda et al.
7,252,196 B1 8/2007 Koefelda et al.
7,281,641 B2 10/2007 Apps
7,311,217 B2 12/2007 Apps
7,322,475 B2 1/2008 Hassell et al.
7,322,486 B2 1/2008 Koefelda et al.
7,353,950 B2 * 4/2008 Stahl ..... B65D 21/0216 206/506
7,549,539 B2 6/2009 Apps
7,604,122 B2 10/2009 Apps et al.
7,658,278 B2 2/2010 Apps et al.
7,677,405 B2 3/2010 Apps et al.
7,694,839 B2 4/2010 Koefelda et al.
D615,758 S 5/2010 Lindstrom
7,735,676 B2 6/2010 Ogburn
7,743,939 B2 6/2010 Stahl
7,950,521 B2 5/2011 Apps
8,056,753 B2 11/2011 Koefelda et al.
8,109,408 B2 2/2012 Hassell
8,123,034 B2 2/2012 Apps et al.
8,672,161 B2 3/2014 Apps
8,720,688 B2 5/2014 Hassell et al.
8,746,513 B2 * 6/2014 Mayo ..... A47G 19/24 220/755
9,010,536 B2 4/2015 McCanless et al.
2001/0015329 A1 8/2001 Apps et al.
2001/0019063 A1 9/2001 Apps
2002/0148837 A1 10/2002 Apps
2002/0195452 A1 12/2002 Apps
2003/0024844 A1 2/2003 Hammett
2003/0029870 A1 2/2003 Apps et al.
2003/0057211 A1 3/2003 Koefelda et al.
2003/0075546 A1 4/2003 Hammett
2005/0017063 A1 1/2005 Noone et al.
2005/0067314 A1 3/2005 Koefelda et al.
2005/0072710 A1 4/2005 Hammett et al.
2005/0279651 A1 12/2005 Perret et al.
2006/0169620 A1 8/2006 Apps
2007/0246392 A1 10/2007 Stahl
2008/0116214 A1 5/2008 Apps et al.
2009/0206088 A1 8/2009 Ogburn
2009/0242568 A1 10/2009 Apps
2010/0084297 A1 4/2010 Apps
2010/0084302 A1 4/2010 Apps
2010/0147642 A1 6/2010 Andochick
2010/0170823 A1 7/2010 Koefelda et al.
2010/0258467 A1 10/2010 Apps
2010/0307949 A1 * 12/2010 Apps ..... B65D 1/243 206/509
2011/0056861 A1 3/2011 Apps
2011/0240659 A1 10/2011 Orgeldinger
2011/0252824 A1 * 10/2011 Dallas ..... B65D 1/26 62/457.5
2012/0152789 A1 6/2012 Apps et al.

* cited by examiner

BEVERAGE CRATE WITH HANDLE

BACKGROUND

Nestable beverage crates typically have side walls and end walls extending upward from a base. Handle openings are formed in the opposed end walls. Depending on the size of the bottles intended to be stored in the crate, the crate may hold a number of bottles. For single-serving size bottles, the crate typically stores 20-24 bottles.

Sometimes, a delivery person or stock person must remove the bottles from the crate and place them on a shelf for individual sale, such as in a refrigerator in the store.

SUMMARY

A nestable crate includes a base, a pair of opposed side walls extending upward from the base, and a pair of opposed end walls extending upward from the base. The side walls and end walls include an upper band portion and a lower portion connecting the base to the upper band portion. A center structure extends from one of the end walls to the other of the end walls. The center structure includes a plurality of center column portions extending down to the base. The center structure further includes an upper handle portion partially defining a handle opening therebelow. The centered handle opening permits a user to hold the crate with one hand while unloading the bottles from the crate with the other hand.

The upper handle portion may include spaced-apart handle side walls defining openings upward of the crate.

DETAILED DESCRIPTION OF A PREFERRED EMBODIMENT

Figure 1:
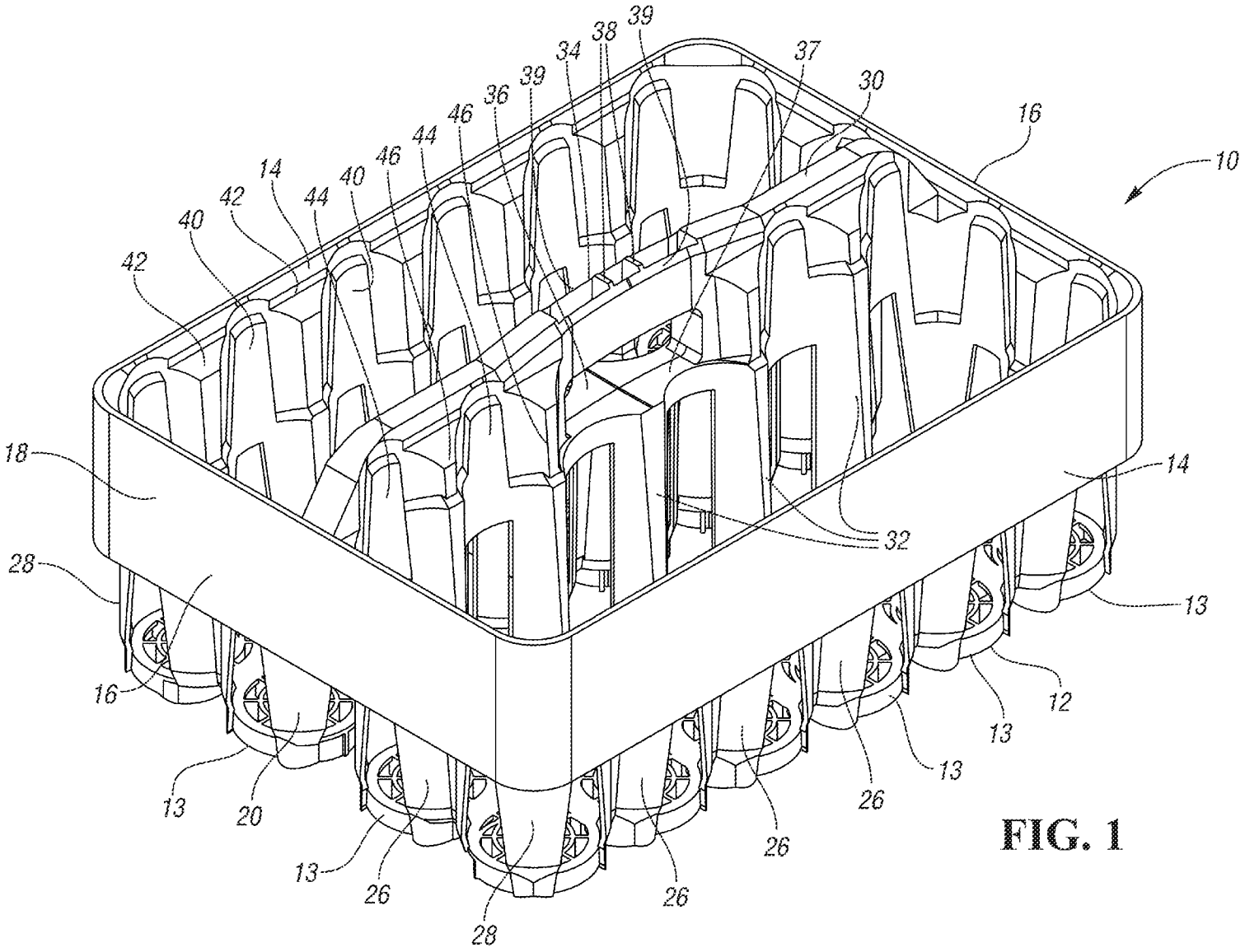
FIG. 1 is a perspective view of a beverage crate.

A beverage container or crate 10 is shown in FIGS. 1-18. Referring to FIG. 1, the crate 10 includes a base 12 and side walls 14 extending upward from side edges of the base 12. End walls 16 (or short walls) extend upward from opposite ends of the base 12. The base 12 includes a plurality of base walls 13 each for supporting a beverage container thereon. The end walls 16 and side walls 15 include an upper band portion 18 and a lower portion 20. The lower portion 20 includes a plurality of columns 26 connecting the upper band portion 18 to the base 12 and spaced inward of the upper band portion 18, such that the lower portion 20 could be nested between the upper band portions 18 of an identical crate nested therebelow. The columns 26 project into the interior of the crate 10 to define bottle-receiving pockets on the base 12. In the example shown, twenty-four bottle-receiving pockets are defined in the crate 10. Corner columns 28 connect the upper band portion 18 to the base 12 at the corners of the crate 10. The end walls 16 and side walls 14 are integrally molded with the base 12 as a single molded piece of plastic.

A center structure 30 extends from the center of one end wall 16 to the center of the opposite end wall 16. The center structure 30 divides the crate 10 into two equal halves and projects above the upper band portion 18. The center structure 30 includes a plurality of column portions 32 extending down to the base 12. The center structure 30 includes an upper handle portion 34 at its center, which is the highest point on the center structure 30 and on the crate 10. The upper handle portion 34 is cored from above and is thus open upward with a pair of ribs 38 formed in the upper handle portion 34. The upper handle portion 34 is open upward between the ribs 38 and outward of the ribs 38. By being cored from above, a smooth, solid surface is provided at the bottom of the upper handle portion 34 for contacting a user's hand. A handle opening 36 is defined below the upper handle portion 34 for receiving a user's hand. A lower handle wall 37 is spaced below the upper handle portion 34 and defines the handle opening 36 therebetween. The upper handle portion 34 includes spaced apart handle side walls 39. The ribs 38 extend from one handle side wall 39 to the other.

The upper portion of the side walls 14 and end walls 16 includes alternating recesses 40 for receiving a bottle and projections 42 partially separating and defining adjacent bottle receiving pockets. Similarly, an upper portion of the center structure 30 includes alternating recesses 44 and projections 46 similarly defining bottle receiving pockets.

The entire crate 10 as described is integrally molded as a single molded piece of plastic.

Figure 2:
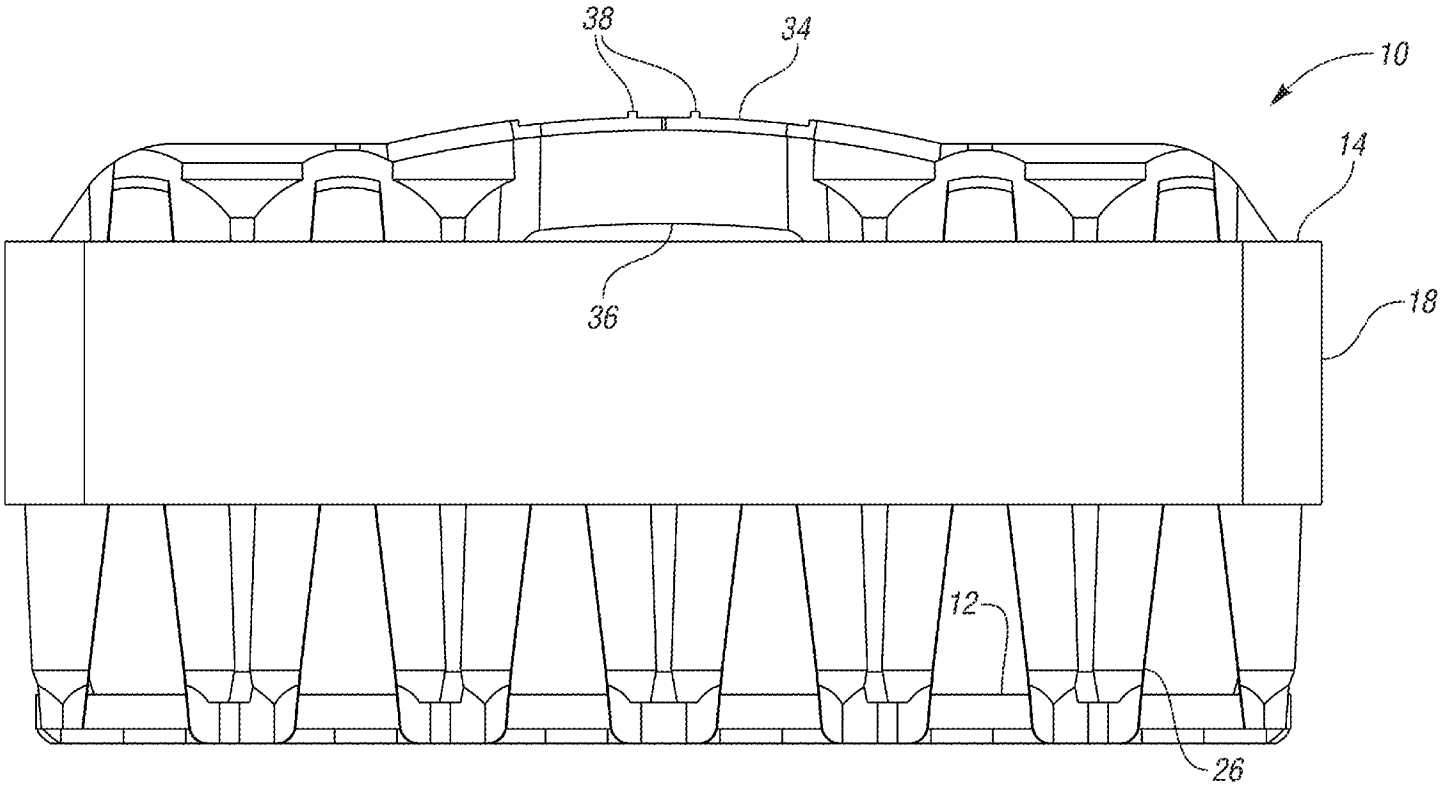
FIG. 2 is a side view of the crate.

FIG. 2 is a side view of the crate 10. As shown, the upper handle portion 34 and a small portion of the handle opening 36 are higher than the upper band portion 18.

Figure 3:
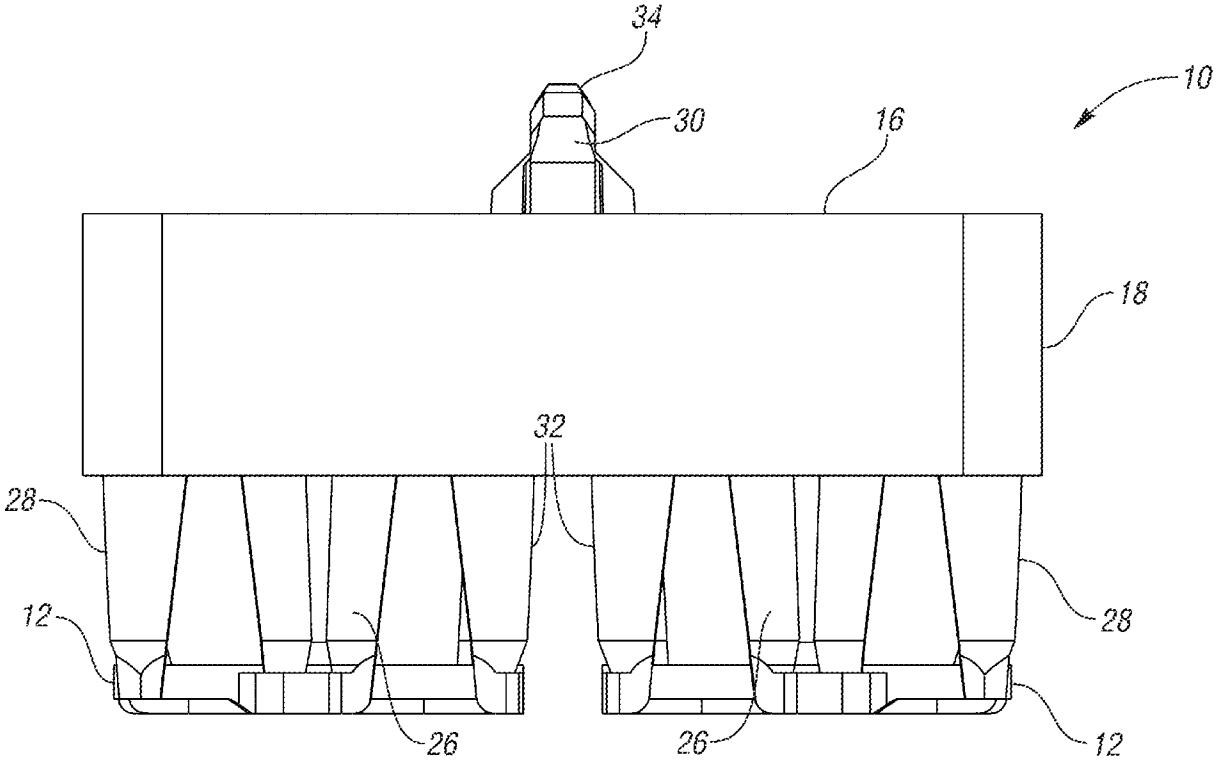
FIG. 3 is an end view of the crate.
Figure 5:
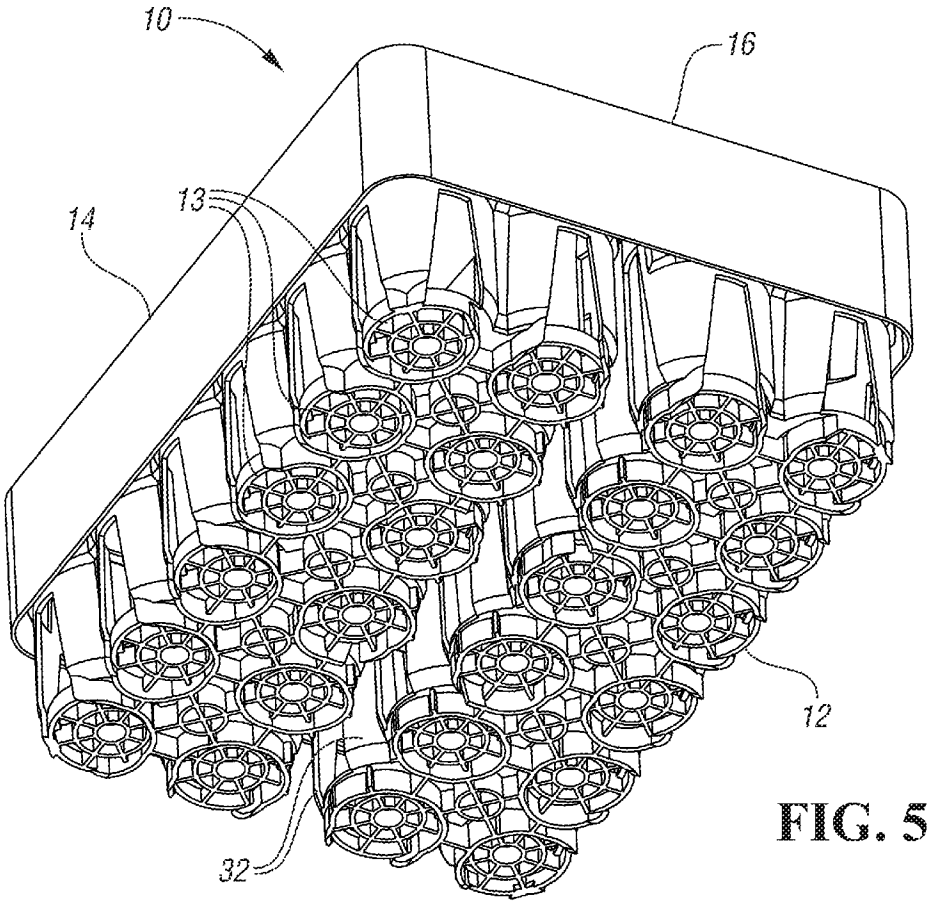
FIGS. 4 and 5 are bottom perspective views of the crate.
Figure 4:
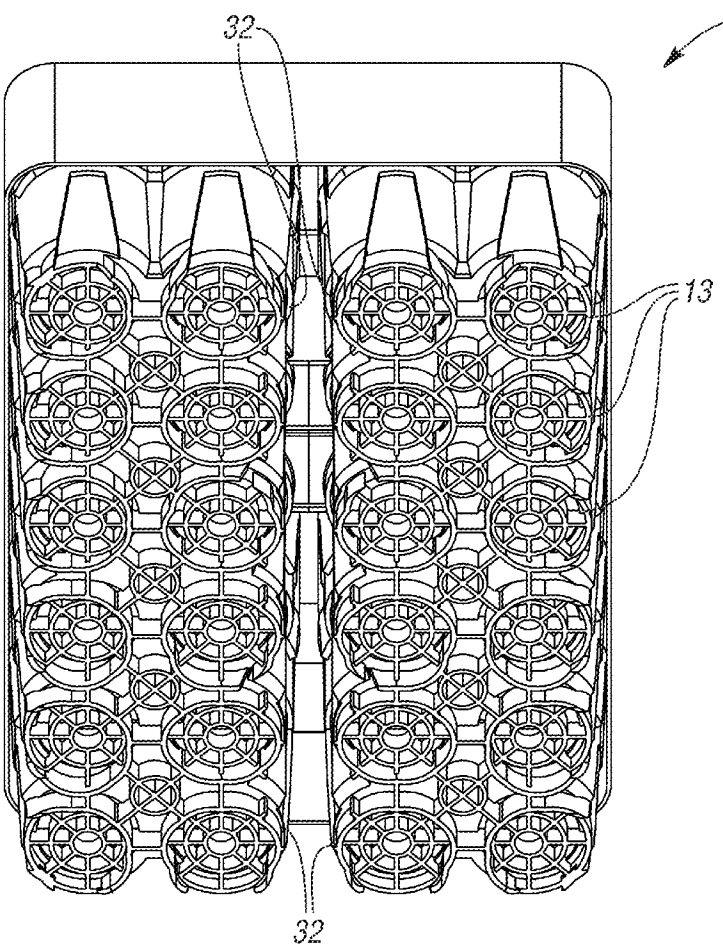

FIG. 3 is an end view of the crate 10. As shown, the column portions 32 of the center structure 30 extend down to different halves of the base 12, separated by a center gap. In each half of the base 12, the base walls 13 are connected to one another by rib structure, but there are no ribs connecting the halves of the base 12 or the column portions 32 below the upper band portion 18. This is shown more clearly in the bottom perspective views of FIGS. 4 and 5.

Figure 6:
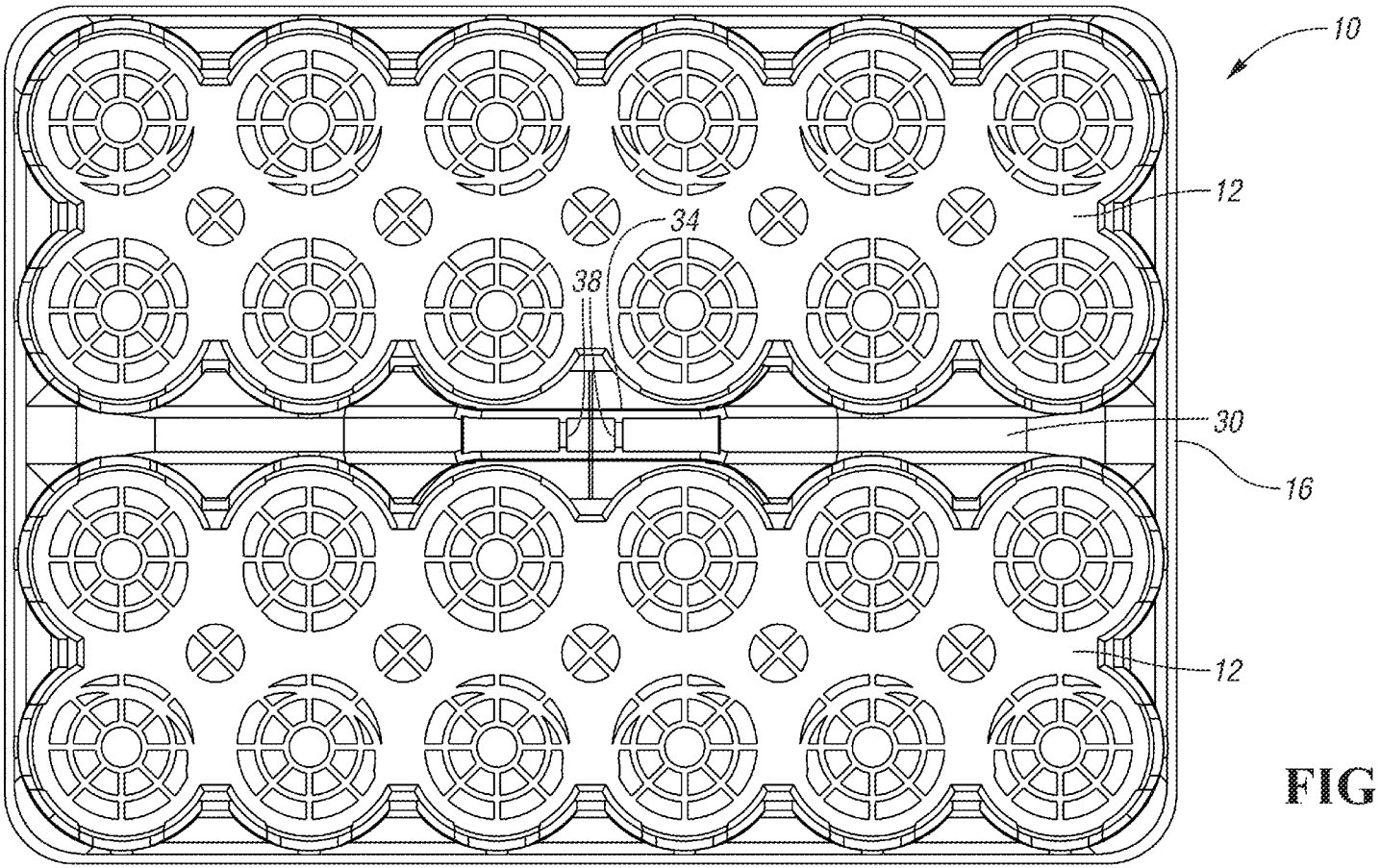
FIG. 6 is a top view of the crate.
Figure 7:
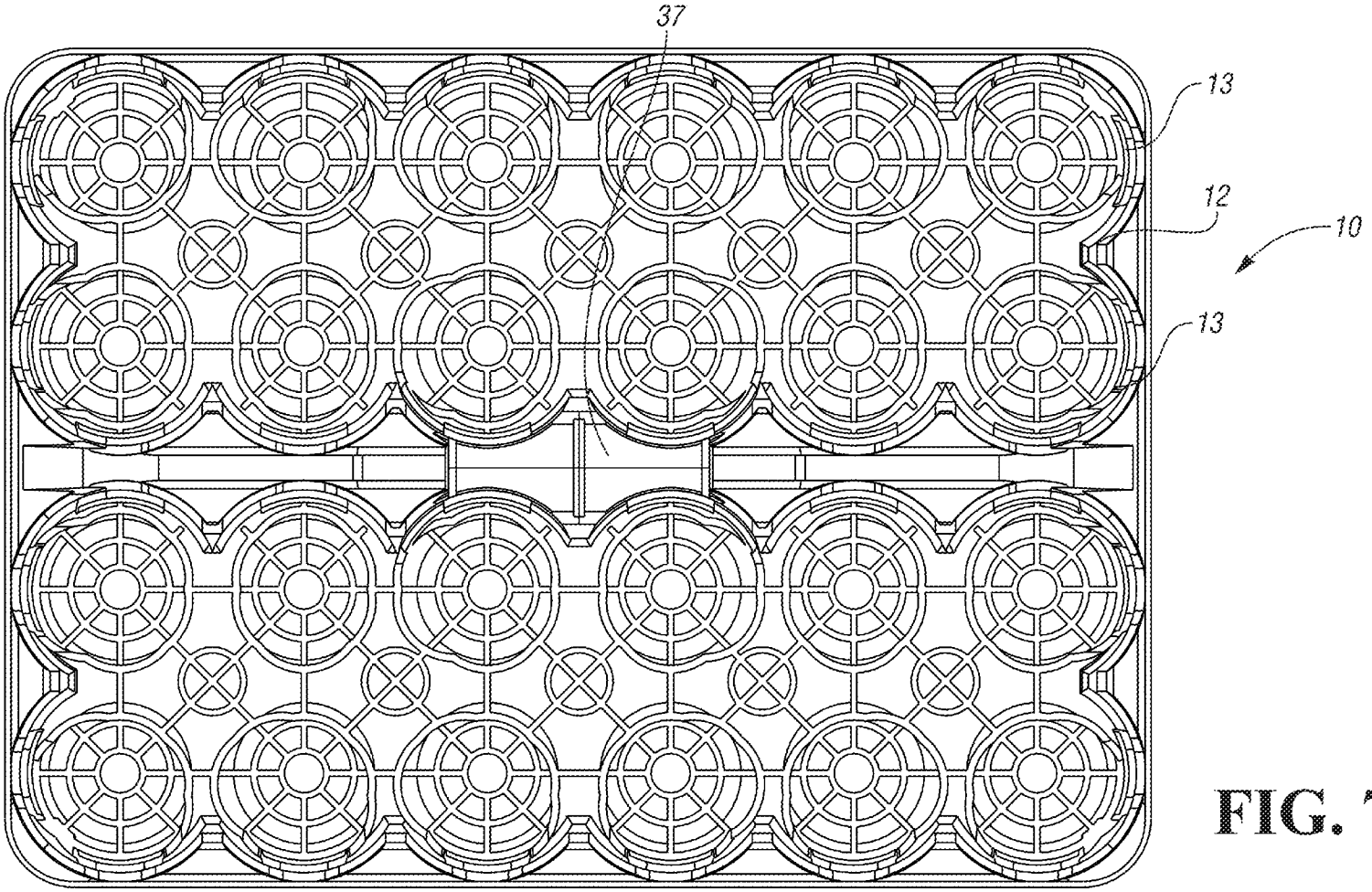
FIG. 7 is a bottom view of the crate.

FIG. 6 is a top view of the crate 10. FIG. 7 is a bottom view of the crate 10.

Figure 8:
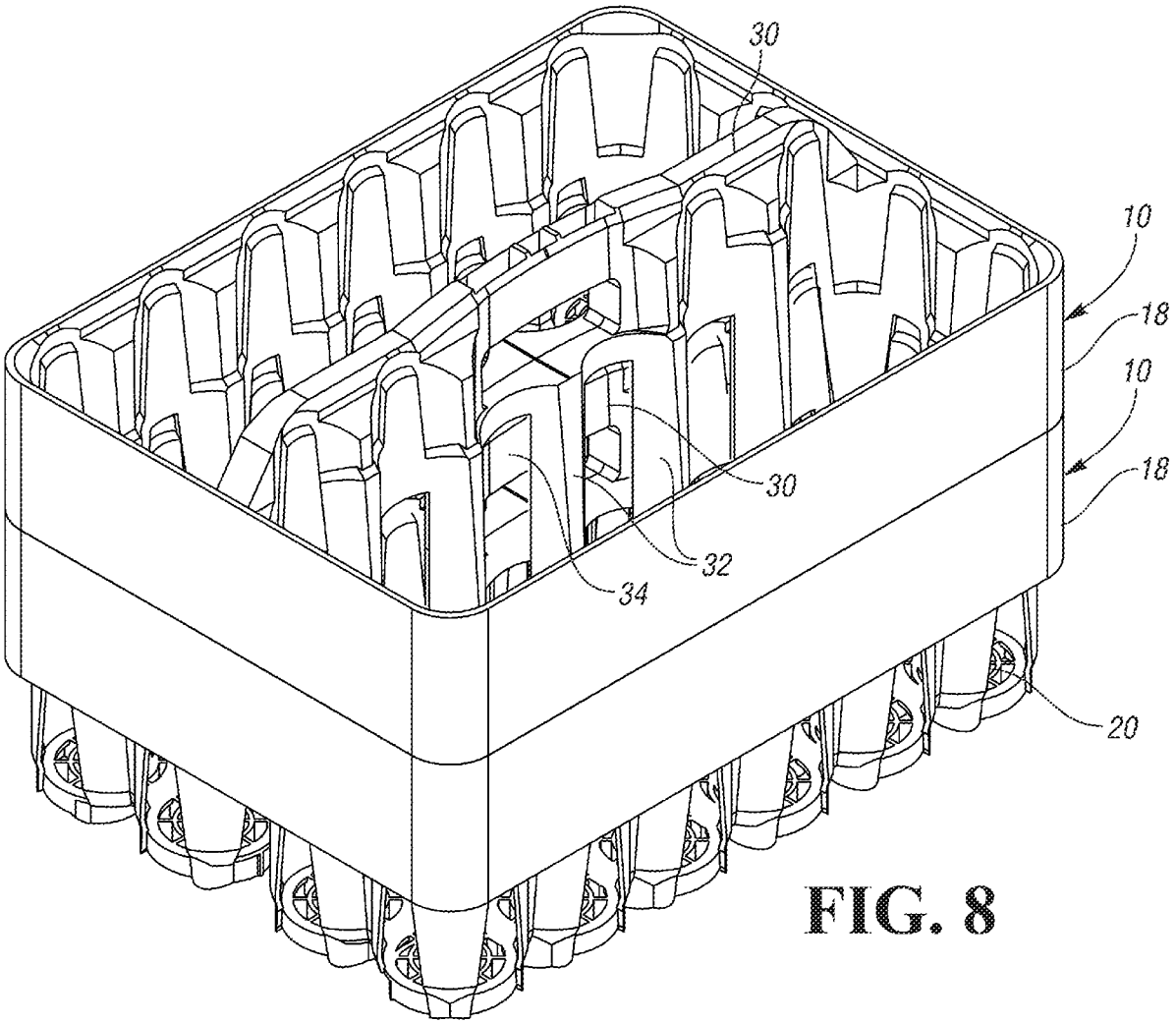
FIG. 8 shows the crate nested with an identical crate.
Figure 9:
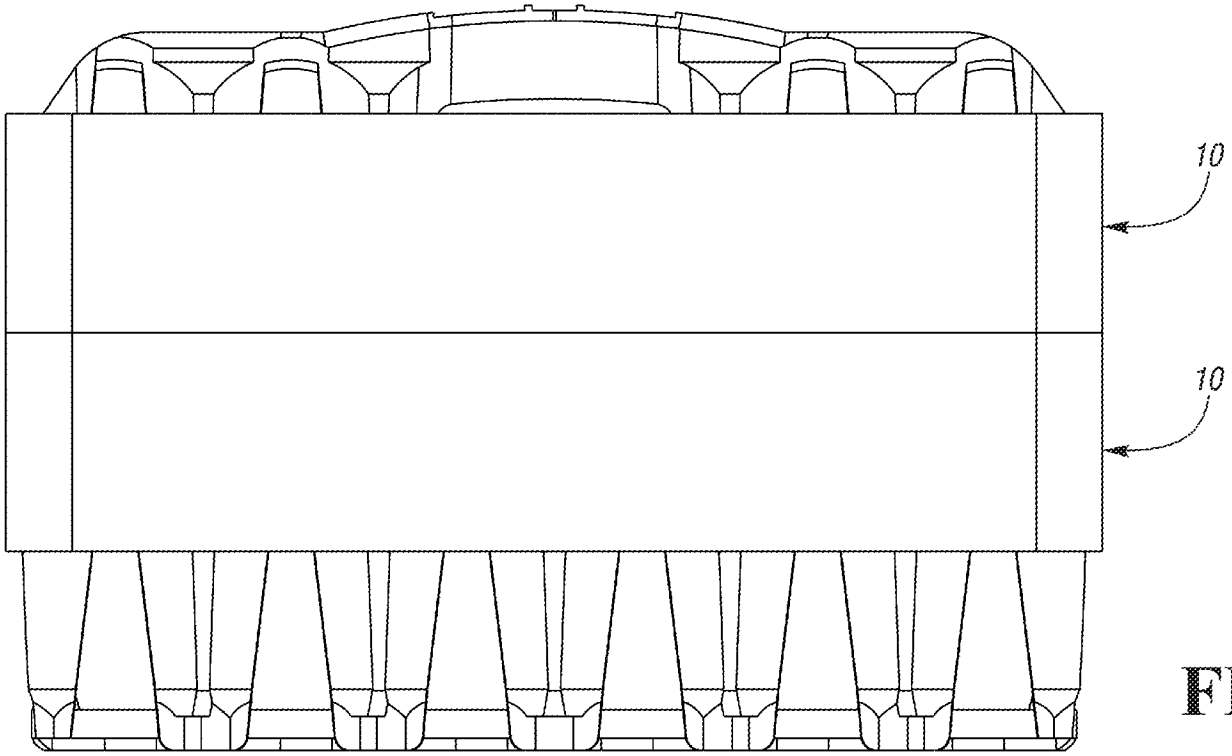
FIG. 9 is a side view of the crates of FIG. 8.
Figure 10:
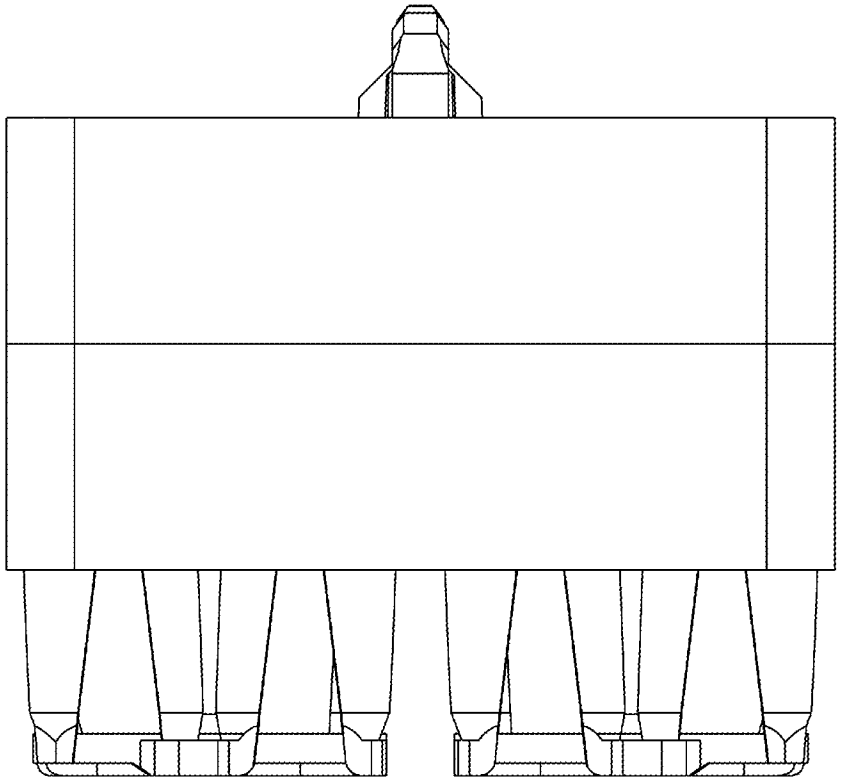
FIG. 10 is an end view of the crates of FIG. 8.

FIG. 8 shows the crate 10 nested with an identical crate 10. The lower portions 20 of the side walls 14 and end walls 16 of the upper crate 10 are received within the upper band portion 18 of the lower crate 10. This reduces the height and volume occupied by the crates 10 when empty. As shown, the center structure 30 of the lower crate 10 nests within the center structure 30 of the upper crate 10, between the column portions 32. FIG. 9 is a side view of the crates 10 of FIG. 8. FIG. 10 is an end view of the crates 10 of FIG. 8.

Figure 11:
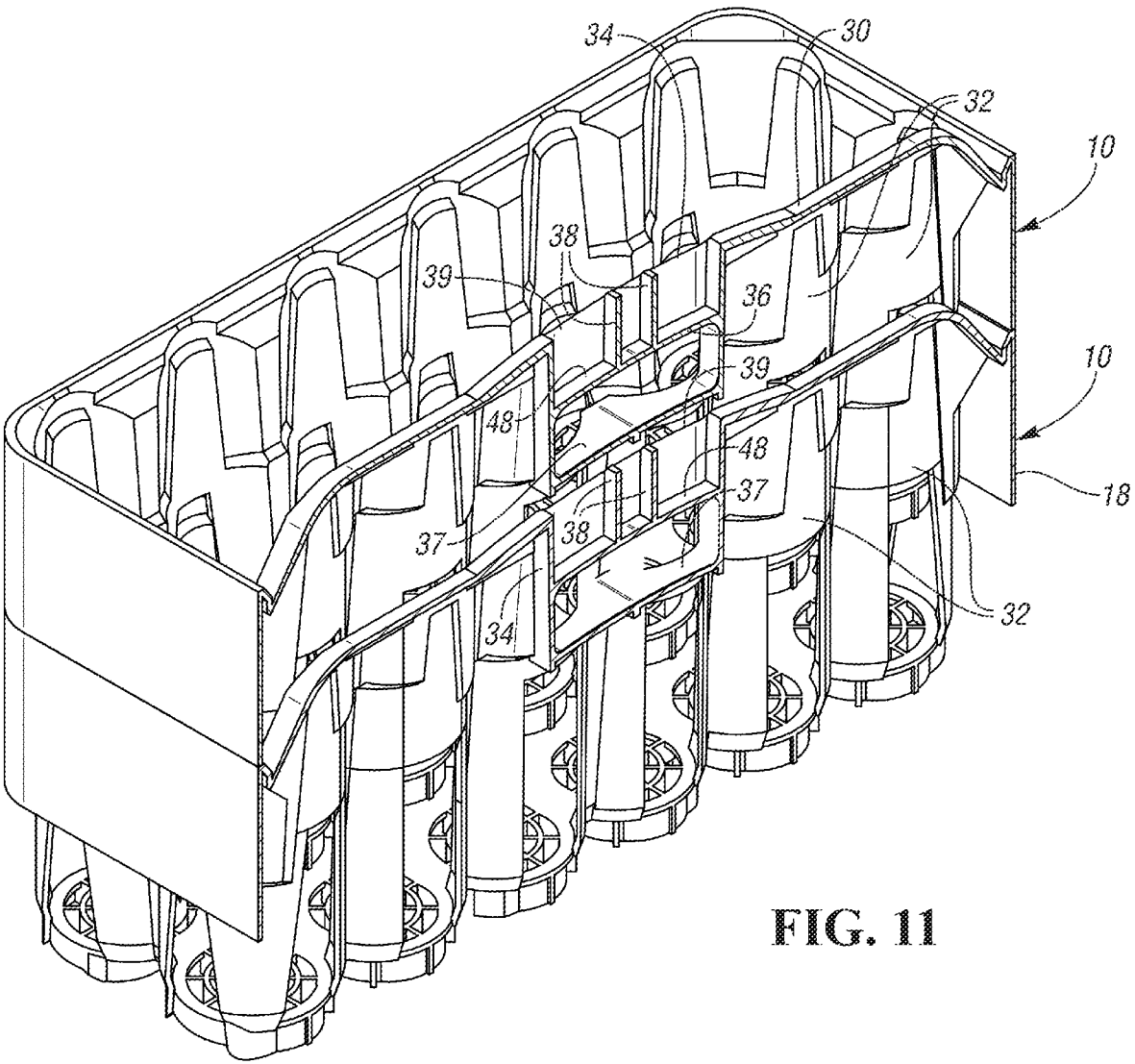
FIGS. 11 and 12 show the crates of FIG. 8 broken away along the longitudinal centerline.
Figure 12:
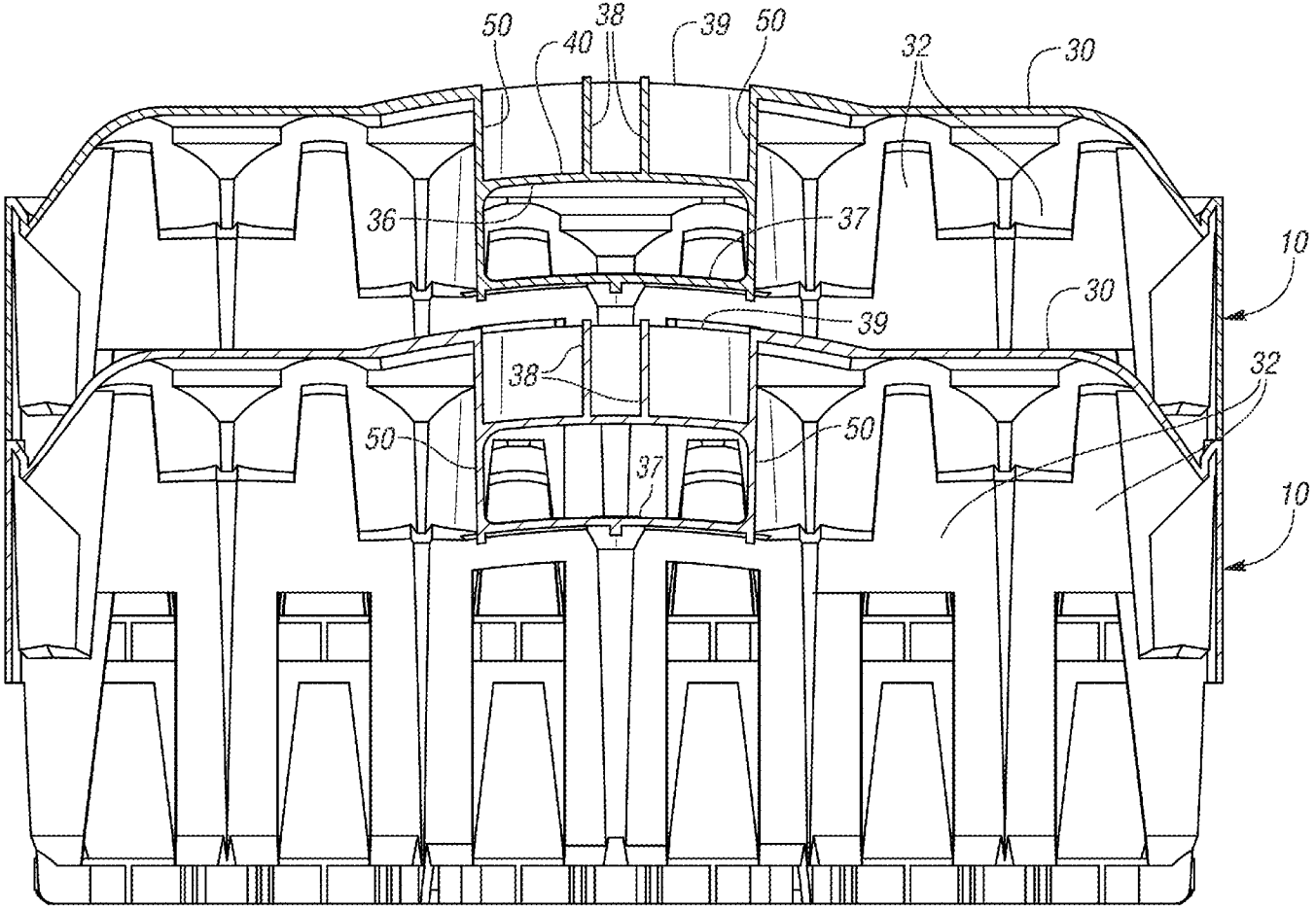

FIGS. 11 and 12 show the crates 10 of FIG. 8 broken away along the longitudinal centerline. This shows more clearly how the center structure 30 of the lower crate 10 is received within the center structure 30 of the upper crate 10. The upper handle portion 34 of the lower crate 10 is received between the column portions 32 of the upper crate 10, below the handle opening 36. Referring to FIG. 12, an upper handle wall 48 is spaced above the lower handle wall 37. The upper handle wall 48 is the lower surface of the upper handle portion 34 and provides the smooth, solid, non-ribbed lower surface that contacts the user's hand. The ribs 38 extend upward from the upper handle wall 48. End handle walls 50 extend from ends of the lower handle wall 37 upward to the upper surface of the upper handle portion 34. The upper handle wall 48 extends from one end handle wall 50 to the other. Notably, all of the structure of the handle, the upper handle portion 34, the ribs 38, the upper handle wall 48, the lower handle wall 37 and the end handle walls 50, connect the two halves of the crate 10.

Figure 13:
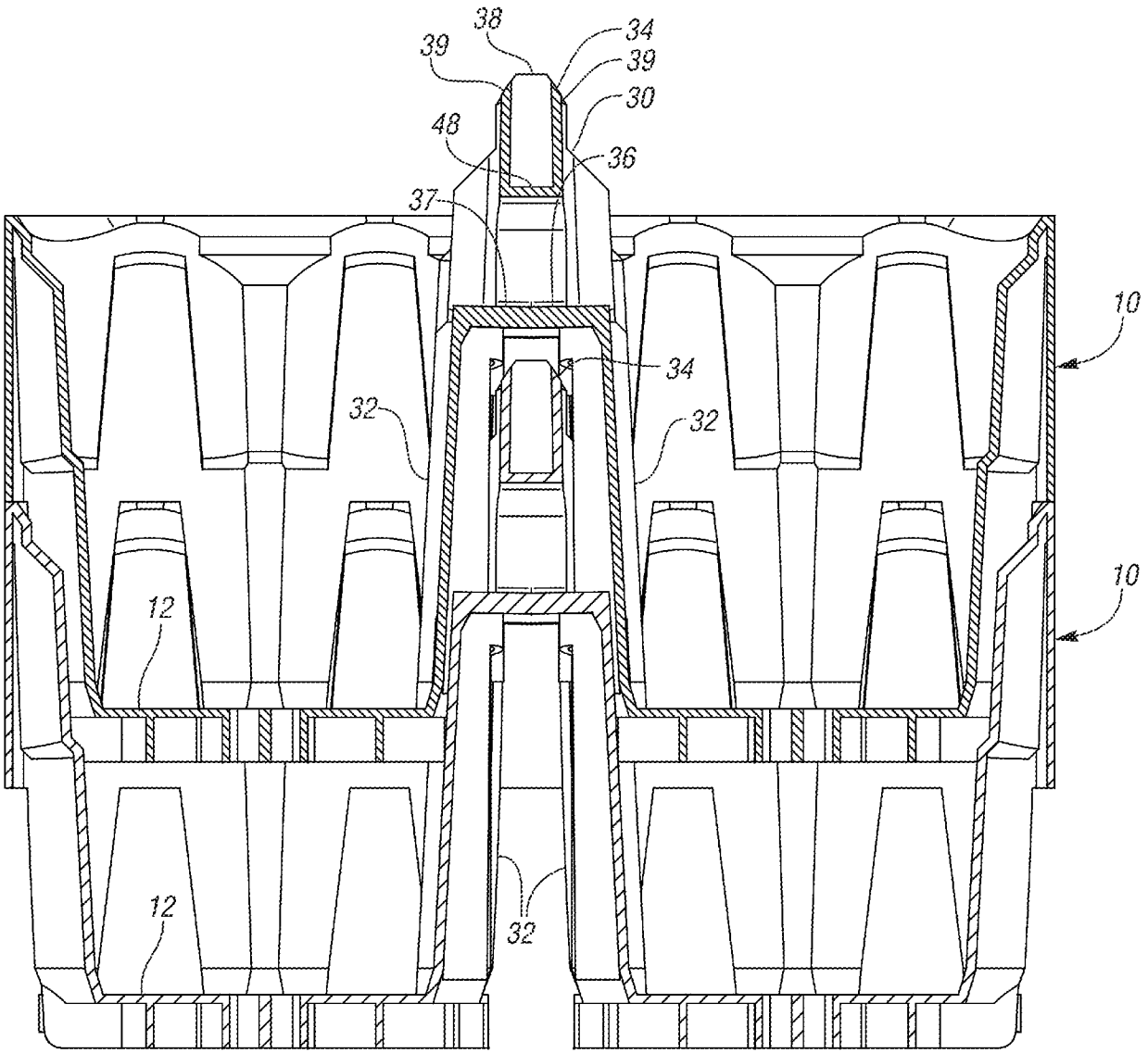
FIGS. 13 and 14 show the crates of FIG. 8 broken away along a lateral centerline.
Figure 14:
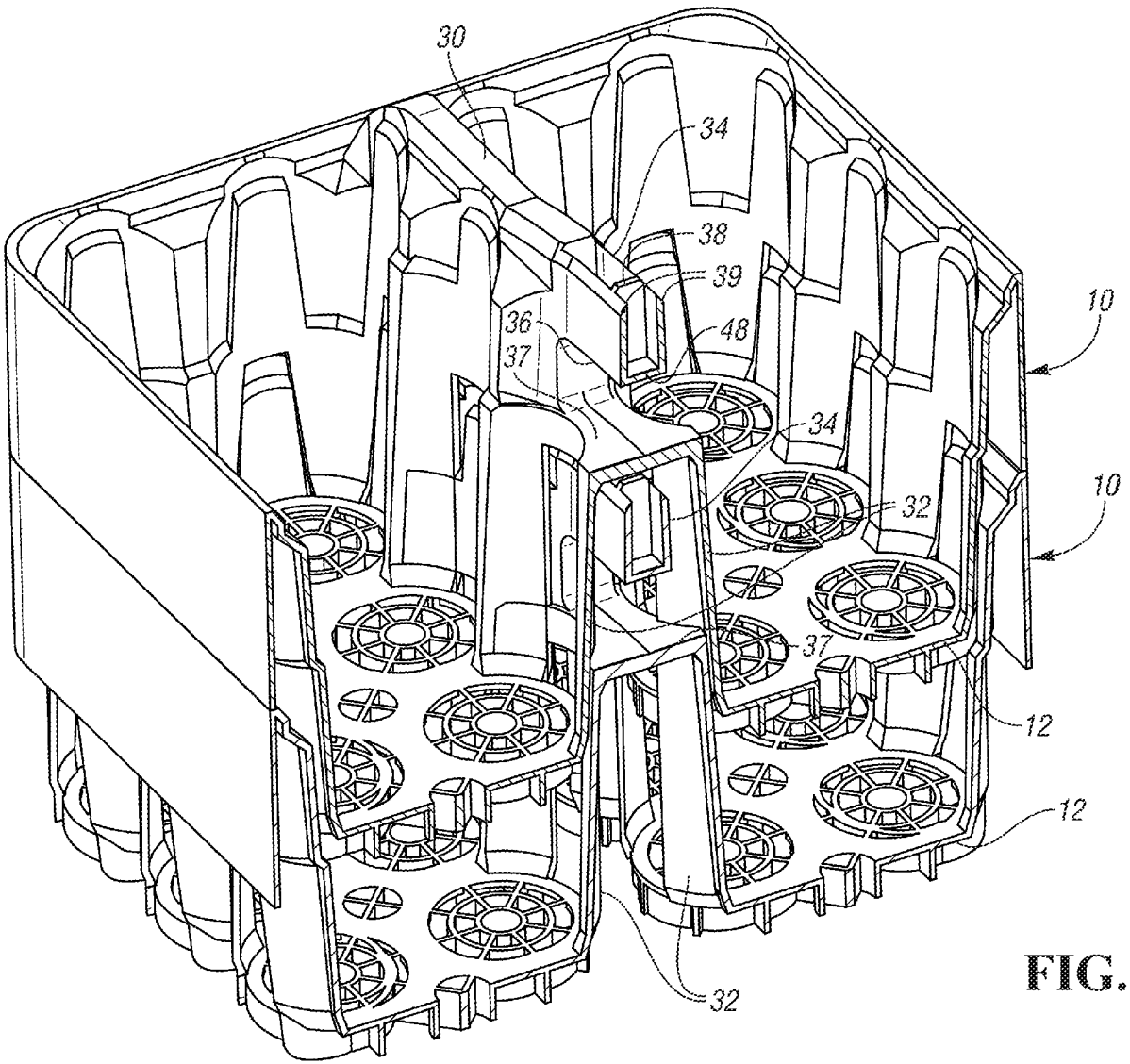

FIGS. 13 and 14 show the crates 10 of FIG. 8 broken away along a lateral centerline. Again, the center structure 30 of the lower crate 10 is received within the center structure 30 of the upper crate 10. The upper handle portion 34 of the lower crate 10 is received between the column portions 32 of the upper crate 10, below the handle opening 36.

Figure 15:
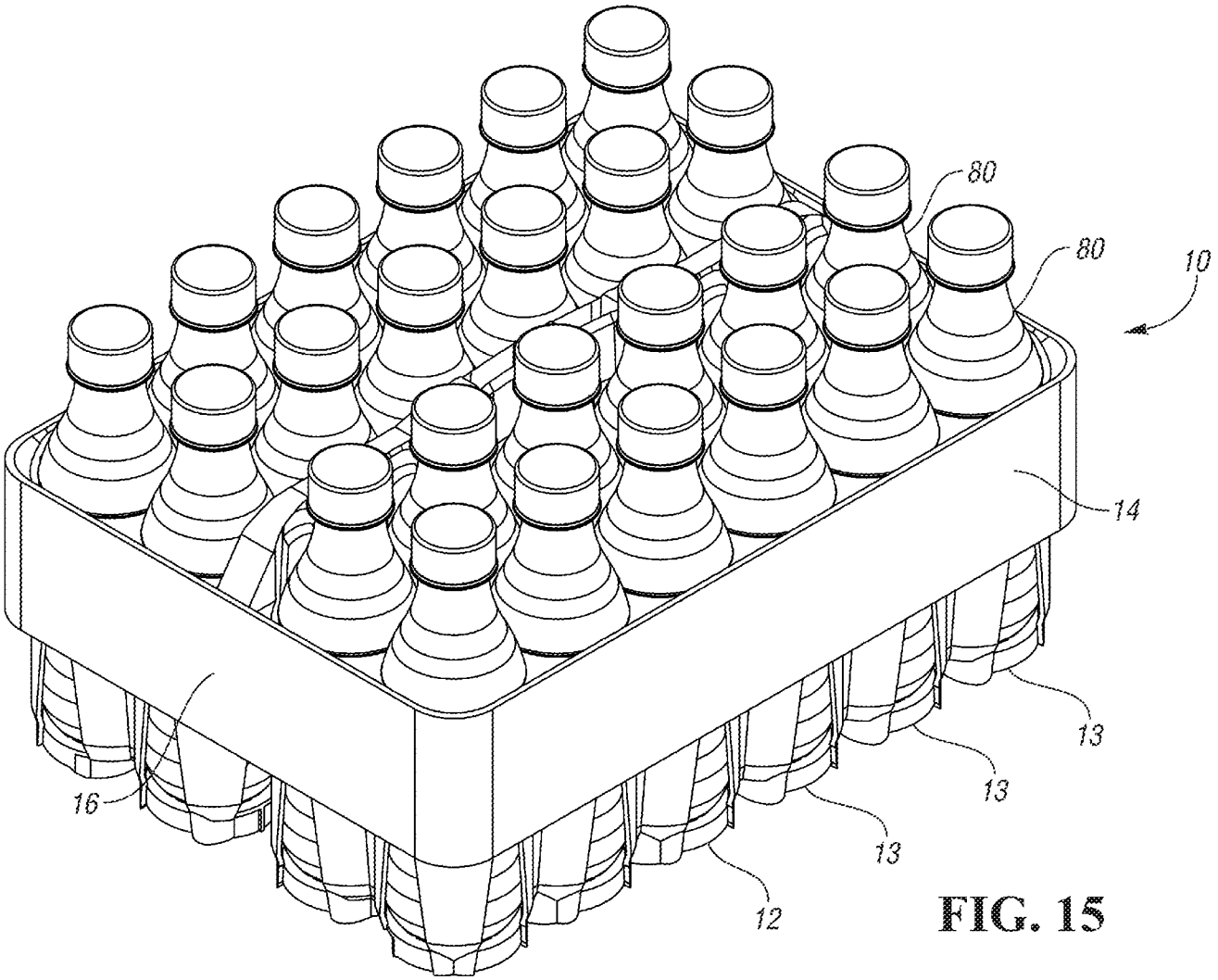
FIG. 15 shows the crate loaded with a plurality of containers.

FIG. 15 shows the crate 10 loaded with a plurality of containers, namely 250 mL plastic beverage bottles 80 (although other containers or other items could also be used). The bottles 80 are supported on the base 12 and held between the side walls 14 and the end walls 16. Each bottle 80 is supported on a different base wall 13. The center structure 30 separates the bottles 80 into each half of the crate 10. The bottles 80 are taller than the center structure 30, such that a similar loaded crate 10 stacked thereon would be supported directly on the bottles 80.

Figure 16:
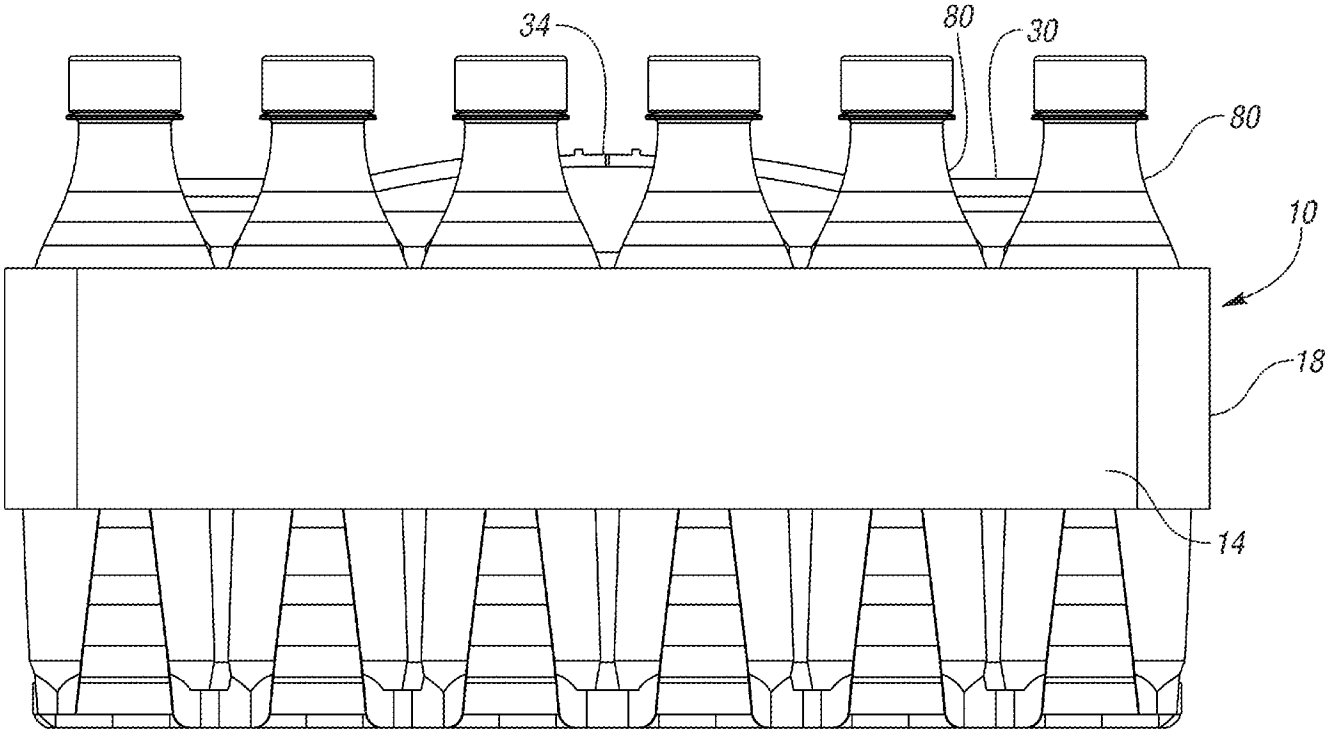
FIG. 16 is a side view of the crate and bottles of FIG. 15.
Figure 17:
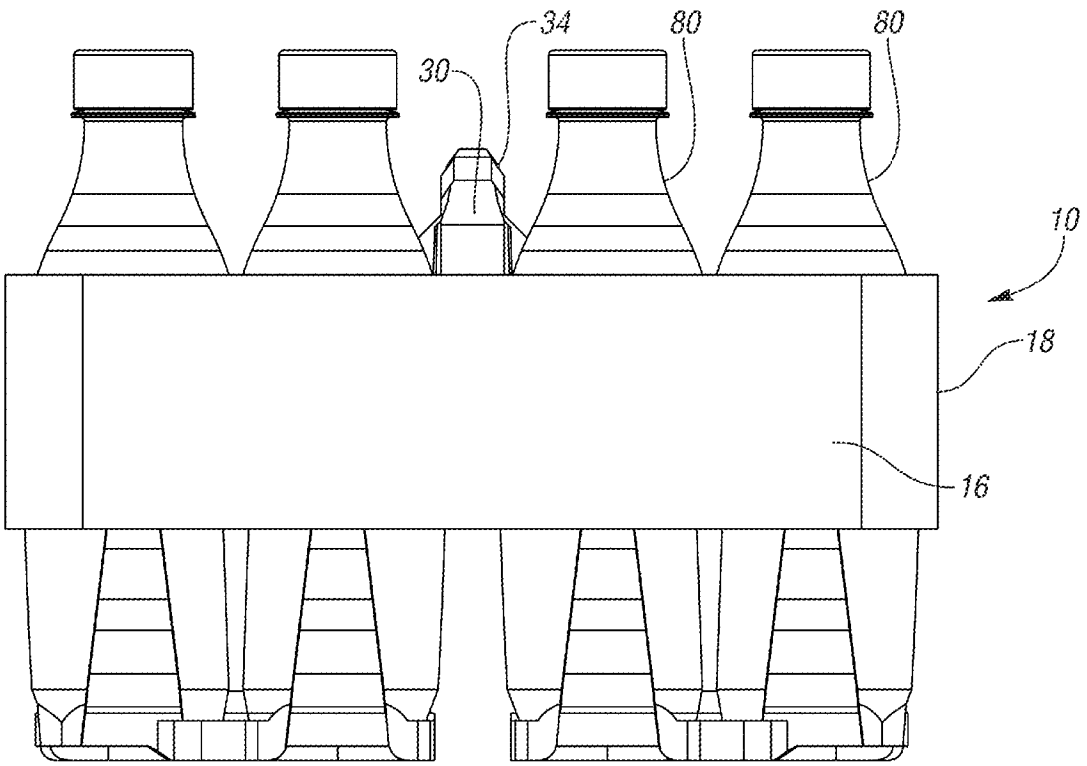
FIG. 17 is an end view of the crate and bottles.
Figure 18:
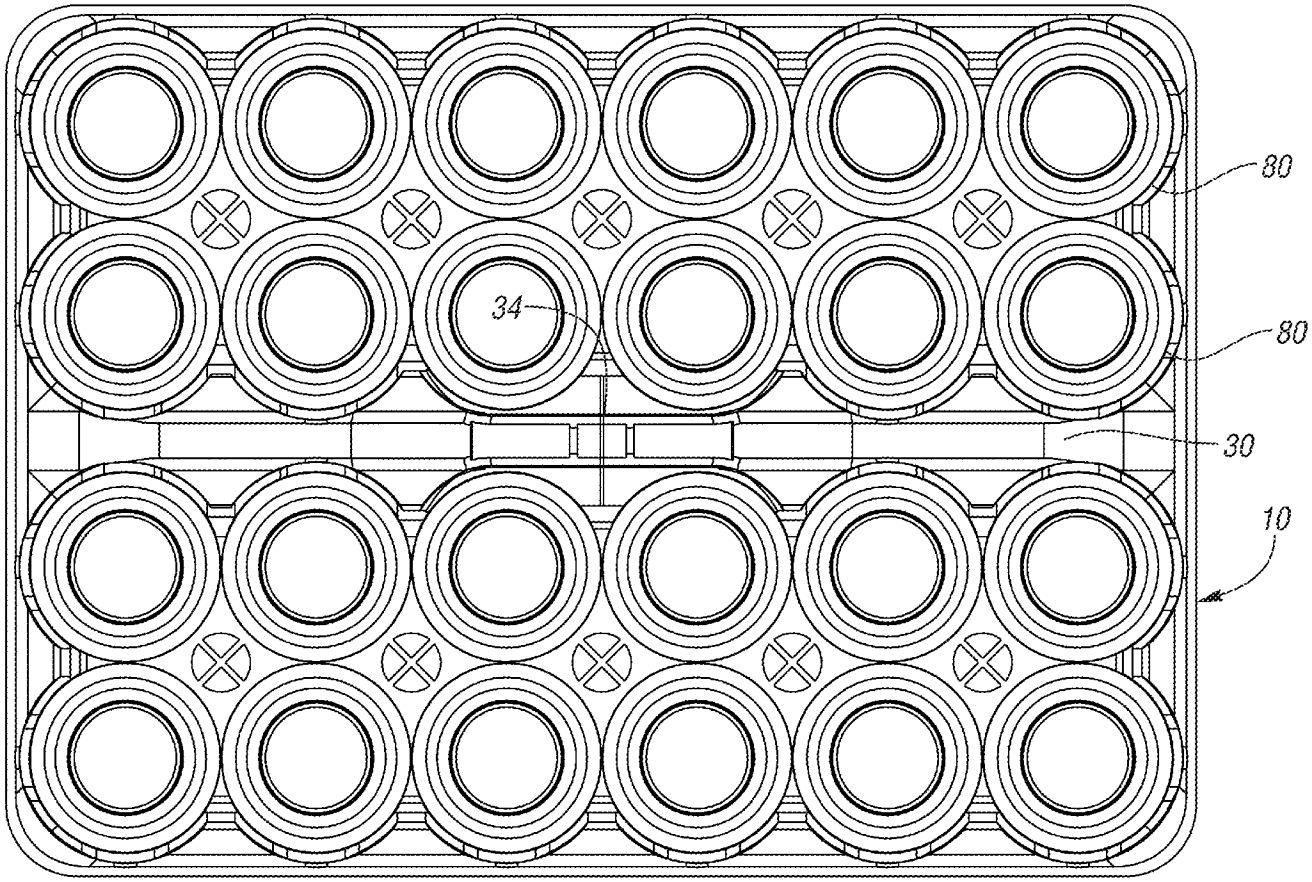
FIG. 18 is a top view of the crate and bottles.

FIG. 16 is a side view of the crate 10 and bottles 80 of FIG. 15. The uppermost surface of the upper handle portion 34 is lower than the uppermost surface of the bottles 80 and lower than the bottle caps. The handle opening 36 below the upper handle portion 34 is aligned with a narrowed or tapered portion of the neck of the bottle 80 to allow more room for the user's hand. The handle opening 36 is also centered between bottles 36 longitudinally. FIG. 17 is an end view of the crate 10 and bottles 80. FIG. 18 is a top view of the crate 10 and bottles 80.

In use, a user can hold the upper handle portion 34 of the crate 10 in one hand while accessing the bottles 80 in the crate 10 with the other hand.

Generally, it is preferred that beverage crates 10 are dimensioned such that they can be arranged efficiently on a standard size pallet. Thus the ratio of the lengths of the end walls and the side walls is sometimes adjusted by making either of them thicker, such as by providing double-walls. However, with the center structure 30 in the present crate 10, the dimension of the end walls can be adjusted by adjusting the width of the center structure 30. Thus, only single-walled end walls 16 and side walls 14 are necessary and the upper band portion 18 can have a constant width all around the crate 10.

In accordance with the provisions of the patent statutes and jurisprudence, exemplary configurations described above are considered to represent a preferred embodiment of the invention. However, it should be noted that the invention can be practiced otherwise than as specifically illustrated and described without departing from its spirit or scope.

What is claimed is:

1. A nestable crate comprising:

a base including a plurality of base walls, each of the plurality of base walls partially defining one of a plurality of bottle-receiving pockets;

a pair of opposed side walls extending upward from the base, each side wall including a plurality of side columns projecting into the crate to partially define the plurality of bottle-receiving pockets and connecting a side upper band portion to the base, each side upper band portion projecting outward of the crate relative to the side columns;

a pair of opposed end walls extending upward from the base, each end wall including a plurality of end columns projecting into the crate, each end column partially defining two of the plurality of bottle-receiving pockets, the plurality of end columns connecting an end upper band portion to the base, each end upper band portion projecting outward of the crate relative to the end columns; and a center structure extending from one of the end walls to the other of the end walls, the center structure including a handle opening therethrough, the center structure including a plurality of center column portions extending down to the base, wherein the center structure divides the crate into two halves, each half having half of the bottle-receiving pockets, wherein the center structure is taller than the side walls and is receivable into an identical nestable crate nested thereon.

2. The nestable crate of claim 1 wherein the end columns each project inward to partially define at least two of the plurality of bottle-receiving pockets.

* * * * *